US009200541B2

(12) United States Patent
Roberts et al.

(10) Patent No.: US 9,200,541 B2
(45) Date of Patent: Dec. 1, 2015

(54) SYSTEMS AND METHODS FOR HYDRAULIC LASH ADJUSTMENT IN AN INTERNAL COMBUSTION ENGINE

(71) Applicant: JACOBS VEHICLE SYSTEMS, INC., Bloomfield, CT (US)

(72) Inventors: Gabriel Scott Roberts, Wallingford, CT (US); Justin Damien Baltrucki, Manchester, CT (US); Kevin Audibert, Wolcott, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 13/946,860

(22) Filed: Jul. 19, 2013

(65) Prior Publication Data

US 2014/0020644 A1 Jan. 23, 2014

Related U.S. Application Data

(60) Provisional application No. 61/674,063, filed on Jul. 20, 2012.

(51) Int. Cl.
*F01L 1/18* (2006.01)
*F01L 9/02* (2006.01)
*F01L 13/06* (2006.01)

(52) U.S. Cl.
CPC . *F01L 1/18* (2013.01); *F01L 9/023* (2013.01); *F01L 13/06* (2013.01); *F01L 2800/10* (2013.01)

(58) Field of Classification Search
CPC ... F01L 2001/2444; F01L 9/02; F01L 1/2411; F01L 1/2416; F01L 1/24; F01L 1/2405; F01L 1/2422; F01L 1/255
USPC ..... 123/90.43, 90.45, 90.46, 90.55, 90.12, 123/320, 321
See application file for complete search history.

(56) References Cited

U.S. PATENT DOCUMENTS

| | | | | | |
|---|---|---|---|---|---|
| 5,161,501 | A * | 11/1992 | Hu | | 123/324 |
| 5,680,841 | A | 10/1997 | Hu | | |
| 5,787,859 | A * | 8/1998 | Meistrick et al. | | 123/321 |
| 6,012,424 | A * | 1/2000 | Meistrick | | 123/321 |
| 6,082,328 | A * | 7/2000 | Meistrick et al. | | 123/321 |
| 6,189,504 | B1 * | 2/2001 | Israel et al. | | 123/321 |
| 6,240,898 | B1 * | 6/2001 | Meistrick et al. | | 123/321 |
| 6,273,057 | B1 * | 8/2001 | Schwoerer et al. | | 123/321 |
| 6,334,429 | B1 * | 1/2002 | Little, Jr. | | 123/320 |
| 6,415,752 | B1 | 7/2002 | Janak | | |

(Continued)

OTHER PUBLICATIONS

Search Report from PCT/US2013/051361 issued on Jan. 9, 2014.

(Continued)

*Primary Examiner* — Jesse Bogue
*Assistant Examiner* — Daniel Bernstein
(74) *Attorney, Agent, or Firm* — Vedder Price, P.C.

(57) ABSTRACT

Systems and methods for actuating engine valves for positive power and engine braking operation are disclosed. The systems may include a self-lashing hydraulic piston slidably disposed in a fixed or rocker arm housing. The hydraulic piston may have an internal cavity in which a motion absorbing piston is disposed. A hydraulic fluid source may communicate with the hydraulic piston bore. A check valve which may be incorporated in a control valve may controls hydraulic fluid supply from the hydraulic fluid source to the hydraulic piston to provide self-lashing operation of the valve actuation system.

22 Claims, 12 Drawing Sheets

(56) References Cited

U.S. PATENT DOCUMENTS

| | | | | |
|---|---|---|---|---|
| 6,718,940 | B2 | 4/2004 | Usko | |
| 6,823,836 | B2 * | 11/2004 | Jung | 123/322 |
| 8,065,987 | B2 * | 11/2011 | Yang | 123/321 |
| 2002/0174654 | A1 | 11/2002 | Yang | |
| 2005/0000499 | A1 * | 1/2005 | Ruggiero et al. | 123/568.14 |
| 2009/0184273 | A1 | 7/2009 | Schwoerer | |

OTHER PUBLICATIONS

International Preliminary Report on Patentability and Written Opinion filed in PCT/US2013/051361, mailed Jan. 29, 2015, 8 pages.

* cited by examiner

SYSTEMS AND METHODS FOR HYDRAULIC LASH ADJUSTMENT IN AN INTERNAL COMBUSTION ENGINE

CROSS REFERENCE TO RELATED APPLICATIONS

This application relates to, and claims the benefit of the earlier filing date and priority of U.S. Patent Application No. 61/674,063, filed Jul. 20, 2012, and entitled "SYSTEMS AND METHODS FOR HYDRAULIC LASH ADJUSTMENT IN AN INTERNAL COMBUSTION ENGINE."

FIELD OF THE INVENTION

The present invention relates to systems and methods for hydraulically adjusting lash space between engine poppet valves and actuators therefore in internal combustion engines.

BACKGROUND OF THE INVENTION

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder. Near the end of the exhaust stroke, another lobe on the camshaft may open the intake valve for the main intake event at which time the piston travels away from the cylinder head. The intake valve closes and the intake stroke ends when the piston is near bottom dead center. Both the intake and exhaust valves are closed as the piston again travels upward for the compression stroke.

The above-referenced main intake and main exhaust valve events are required for positive power operation of an internal combustion engine. Additional auxiliary valve events, while not required, may be desirable. For example, it may be desirable to actuate the intake and/or exhaust valves during positive power or other engine operation modes for compression-release engine braking, bleeder engine braking, exhaust gas recirculation (EGR), brake gas recirculation (BGR), or other auxiliary intake and/or exhaust valve events. FIG. 6 illustrates examples of a main exhaust event 700, and auxiliary valve events, such as a compression-release engine braking event 710, bleeder engine braking event 720, exhaust gas recirculation event 740, and brake gas recirculation event 730, which may be carried out by an engine valve using various embodiments of the present invention to actuate engine valves for main and auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, and/or bleeder type braking.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down. An example of a prior art compression release engine brake is provided by the disclosure of the Cummins, U.S. Pat. No. 3,220,392 (November 1965), which is hereby incorporated by reference.

During bleeder type engine braking, in addition to, and/or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Exhaust gas recirculation (EGR) systems may allow a portion of the exhaust gases to flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Generally, there are two types of EGR systems, internal and external. External EGR systems recirculate exhaust gases back into the engine cylinder through an intake valve(s). Internal EGR systems recirculate exhaust gases back into the engine cylinder through an exhaust valve(s) and/or an intake valve(s). Embodiments of the present invention primarily concern internal EGR systems.

Brake gas recirculation (BGR) systems may allow a portion of the exhaust gases to flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

During operation of an engine, beginning from a cold start, certain engine components heat up and may experience thermal expansion. Additionally, over the life of an engine, engine components may wear, and thus change size and shape. Engine poppet valves and the systems used to actuate them are exposed to significant temperature changes and potential wear, and accordingly, these systems must allow for thermal growth and other phenomena that may affect actuation of the engine valves. Historically, thermal growth and the like have been accommodated by providing a lash space between the engine valve (or a valve bridge that spans two or more engine valves) and the valve actuator, such as a rocker arm, cam, push tube, and the like. This lash space has been set manually, or in some cases, automatically, using hydraulic lash adjusters between the engine valve and the valve actuator.

Hydraulic lash adjustors, however, have not been used to automatically adjust lash space between an engine valve and a valve actuation system designed to provide both positive power and auxiliary engine valve events, such as engine braking events. Accordingly, lash has been set manually in engines equipped with compression-release or bleeder type engine brakes. Manually setting lash may be a cumbersome and expensive process required both at the factory during manufacturing and in service. A system for hydraulically adjusting lash in engines equipped with an engine brake may reduce or even eliminate the need for automatic lash setting machines at the factory, cutting production time and assembly cost. Further, such systems may reduce maintenance needs and thereby provide even more savings.

An advantage of some, but not necessarily all, embodiments of the present invention may result from providing a hydraulic lash adjustor of the type described herein in systems that provide both positive power and auxiliary valve events. For example, it is not uncommon for engine valve float to occur as the result of an over speed condition or high exhaust backpressure in the engine. In such situations, a conventional hydraulic lash adjuster may "jack" by progressively locking excess hydraulic fluid in the lash adjustment circuit such that the engine valve at issue does not close properly even when the cam actuating it is at base circle. Unlike these conventional hydraulic lash adjusters, embodiments of the invention may be largely impervious to jacking due to the operation of the motion absorbing piston.

SUMMARY OF THE INVENTION

Responsive to the foregoing challenges, Applicants have developed an innovative system for hydraulic lash adjustment and engine valve actuation comprising: a housing disposed above an engine valve train element, said housing having a piston bore and a hydraulic fluid supply passage communicating with the piston bore; a hydraulic piston slidably disposed in the piston bore, said hydraulic piston having an internal cavity; a motion absorbing piston slidably disposed in the hydraulic piston internal cavity; a hydraulic fluid source communicating with the hydraulic fluid supply passage; a check valve in the hydraulic fluid supply passage between the hydraulic fluid source and the piston bore; a first spring disposed between the motion absorbing piston and the hydraulic piston; and a second spring biasing the hydraulic piston into the piston bore.

Applicants have further developed an innovative system for hydraulic lash adjustment and engine valve actuation comprising: first and second engine valves; a valve bridge extending between the first and second engine valves; a sliding pin extending through an end of the valve bridge, wherein the sliding pin contacts the first engine valve; means for actuating both the first and second engine valves through the valve bridge to provide a main valve event; a housing disposed above the valve bridge, said housing having a piston bore and a hydraulic fluid supply passage communicating with the piston bore; a hydraulic piston slidably disposed in the piston bore, said hydraulic piston having an internal cavity; a motion absorbing piston slidably disposed in the hydraulic piston internal cavity; a hydraulic fluid source communicating with the hydraulic fluid supply passage; a control valve incorporating a check valve disposed in the hydraulic fluid supply passage between the hydraulic fluid source and the piston bore; a first spring disposed between the motion absorbing piston and the hydraulic piston; a second spring biasing the hydraulic piston into the piston bore; and a cam operatively connected to the hydraulic piston, said cam having an auxiliary event lobe, wherein the hydraulic piston or the motion absorbing piston contact the sliding pin.

Applicants have still further developed an innovative system for hydraulic lash adjustment and engine valve actuation comprising: a rocker arm having a piston bore and a hydraulic fluid supply passage communicating with the piston bore; a hydraulic piston slidably disposed in the piston bore, said hydraulic piston having an internal cavity; a motion absorbing piston slidably disposed in the hydraulic piston internal cavity; a hydraulic fluid source communicating with the hydraulic fluid supply passage; a check valve in the hydraulic fluid supply passage between the hydraulic fluid source and the piston bore; a first spring disposed between the motion absorbing piston and the hydraulic piston; a second spring biasing the hydraulic piston into the piston bore; a cam operatively contacting the rocker arm, said cam having a main event lobe and an auxiliary event lobe; a reset bore provided in the housing; a reset passage extending through the housing from the piston bore to the reset bore; and a reset piston disposed in the reset bore, wherein the hydraulic piston or the motion absorbing piston contact the engine valve.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

Figure 1:
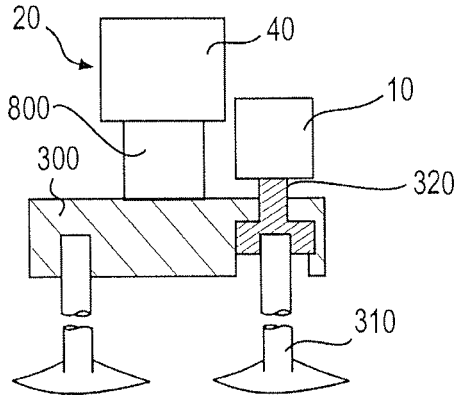
FIG. 1 is a schematic diagram of bridged engine valves including a self-lashing system for engine braking in accordance with one or more embodiments of the present invention.

With reference to FIG. 1, in one or more embodiments of the present invention, two or more engine valves 310 may be connected by a valve bridge 300. A first valve actuation system 20 may be used to provide the engine valves with positive power valve actuation, such as main intake or main exhaust valve actuation. The first valve actuation system 20 may include one or more valve train elements, such as rocker arms, cams, push tubes and hydraulically adjusted components. A second valve actuation system 10 may be used to provide one of the engine valves 310 with auxiliary valve actuation motion, such as engine braking valve actuation. The second valve actuation system 10 may include a self-lashing hydraulic actuator which acts on a sliding pin 320 to actuate the engine valve 310 while also automatically adjusting lash space between the second valve actuation system and the sliding pin.

The first valve actuation system 20 may, optionally, include a hydraulic lash adjuster 800 which is designed to automatically adjust a lash space between the first valve actuation system and the valve bridge 300. The hydraulic lash adjuster portion 800 of the first valve actuation system 20 may be provided in either a rocker arm 40 or the valve bridge 300 and designed so that it does not "jack" (i.e., take up more than the desired amount of lash space) when used in combination with the second valve actuation system 10.

Figure 9:
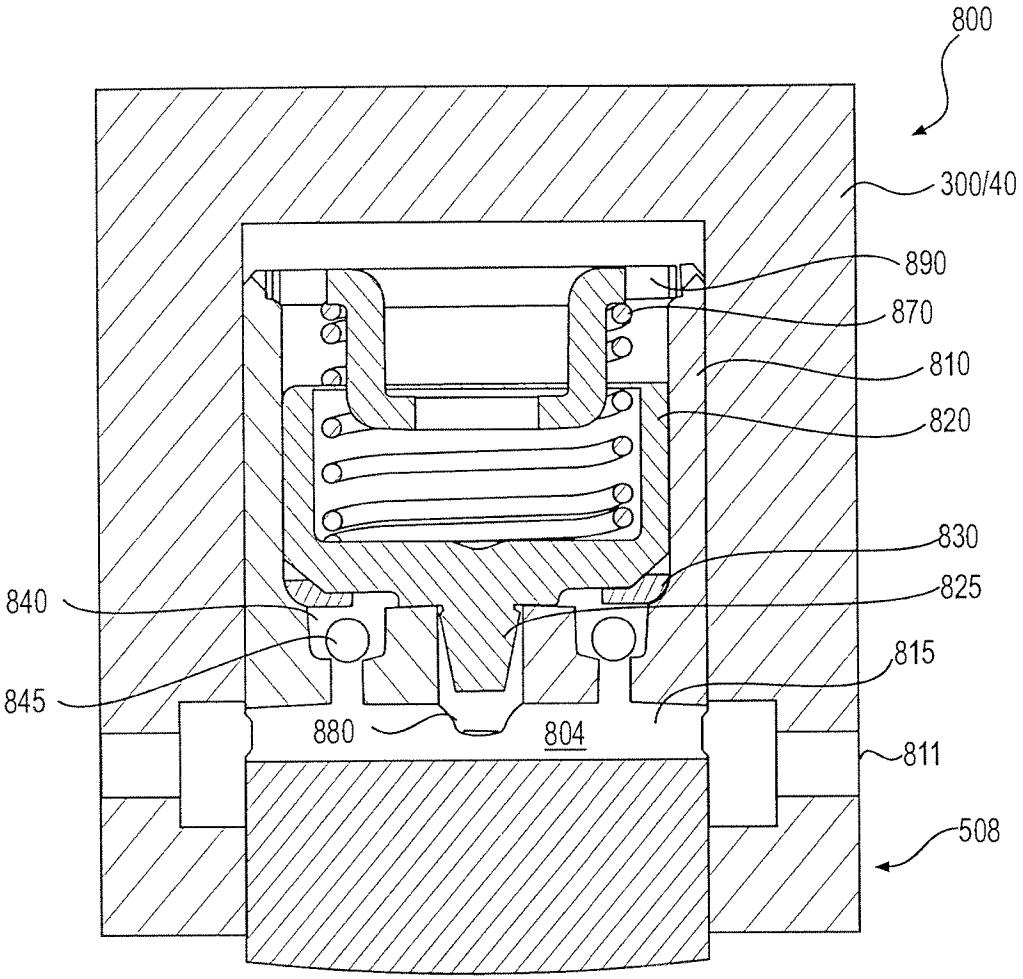
FIG. 9 is a cross-sectional view of a hydraulic lash adjuster that may be used in connection with the FIGS. 3A-3E and 4A-4D embodiments of the present invention.

A non-limiting example of a non-jacking hydraulic lash adjuster that may be used in the first valve actuation system 20 is illustrated in FIG. 9. With regard to FIG. 9, a cylindrically shaped outer piston 810 may be slidably disposed in the housing comprised of the valve bridge 300 or a rocker arm 40. The outer piston 810 may include a hollow interior portion, a central orifice 880 in a lower portion of the outer piston, one or more check passages 840, a fluid passage 815 in an lower portion of the outer piston and below the central orifice 880, and a upper end. One or more check balls 845 which may rest on a seat at the upper end of each check passage 840. The check balls permit one-way fluid flow from the lower housing portion 804 to the space between the outer piston 810 and the catch piston 820. The check balls 845 may permit extra refill of the hydraulic lash adjuster 800 with hydraulic fluid during engine operation.

With continued reference to FIG. 9, the central orifice 880 may permit hydraulic fluid to flow between the hollow interior portion of the outer piston 810 and the fluid passage 815. The outer piston 810 may include a lower end which contacts the valve bridge 300. The lower end of the outer piston 810 permits transfer of engine valve closing force and valve seating resistance between the engine valves 310 and the hydraulic lash adjuster 800.

As shown in FIG. 9, a cylindrically-shaped catch piston 820 may be slidably disposed in the hollow interior portion of the outer piston 810 and rest against a ring 830. The catch piston 820 may include a cone-shaped extension 825 which extends from the bottom of the catch piston into the orifice 880 when the catch piston 820 is resting against the ring 830 in the outer piston 810. The catch piston 820 may also include a hollow interior portion.

The cone-shaped extension 825 of the catch piston 820 may be selectively shaped to taper from its base to its lower terminus. The taper of the cone-shaped extension 825 may be selected to have substantially the same diameter of the orifice 880 at its base and a smaller diameter at its lower terminus. The cone-shaped extension 825 may taper linearly, progressively, or less than linearly from base to terminus depending upon the desired level of throttling of the flow of fluid through the orifice 880 during valve actuation events and for lash adjustment.

A cap 890 may be provided at the upper end of the outer piston 810. A catch piston spring 870 may be disposed in the interior portions of the catch piston 820. The catch piston spring 870 may bias the catch piston 820 and the cap 890 away from each other.

In order to slow the valve during valve seating events and to establish a full hydraulic link between the outer piston 810 and the catch piston 820, hydraulic fluid may be provided to the hydraulic lash adjuster 800 from a source of engine lubricant (not shown) through the housing side wall openings 811 and into the fluid passage 815. The incoming fluid may flow into the outer piston 810 and through the central orifice 880. The fluid may fill the interior of the outer piston 810 without restriction, taking up the full lash between the outer piston 810 and the catch piston 820. Hydraulic fluid may also leak past the space between the catch piston 820 and the outer piston 810 to fill all interior spaces of the hydraulic lash adjuster 800, including the interior portions of the catch piston and the outer piston, as well as the space above the cap 890. The fill rate of the space above the cap 890 to take up lash is designed to be sufficiently slow such that it does not change markedly from engine cycle to engine cycle and will not change substantially for the duration of a single engine cycle. As a result, the lash adjuster 800 reduces the likelihood of "jacking" when used in cooperation with a hydraulic lash adjuster for engine braking (discussed below). As the interior spaces of the hydraulic lash adjuster 800 fill with hydraulic fluid, outer piston 810 is pushed downward to take up any lash space that may exist between the outer piston and the valve bridge 300. At the same time, the hydraulic pressure above and below the catch piston 810 may become equalized so that the catch piston 820 is biased downwards against the outer piston 810 by the catch spring 870 as shown in FIG. 9, thus stopping the flow of fluid through orifice 880.

Figure 2:
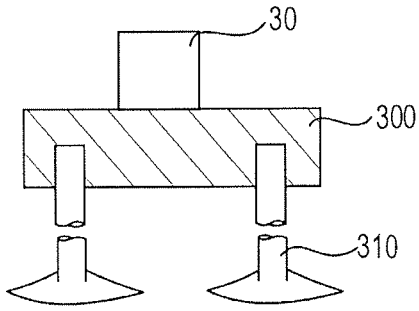
FIG. 2 is a schematic diagram of bridged engine valves including a self-lashing system for engine braking in accordance with one or more alternative embodiments of the present invention.

With reference to FIG. 2, in one or more alternative embodiments of the present invention, two or more engine valves 310 may be connected by a valve bridge 300. A third valve actuation system 30 may be used to provide the engine valves with both positive power valve actuation, such as main intake or main exhaust valve actuation, and with auxiliary valve actuation motion, such as engine braking valve actuation. The third valve actuation system 30 may include a self-lashing hydraulic actuator which acts on the valve bridge 300 to actuate the engine valves 310 while also automatically adjusting lash space between the third valve actuation system and the valve bridge. Alternatively, the third valve actuation system 30 may act directly on a single engine valve (such as shown, for example, in FIGS. 5A-5E).

Figure 3B:
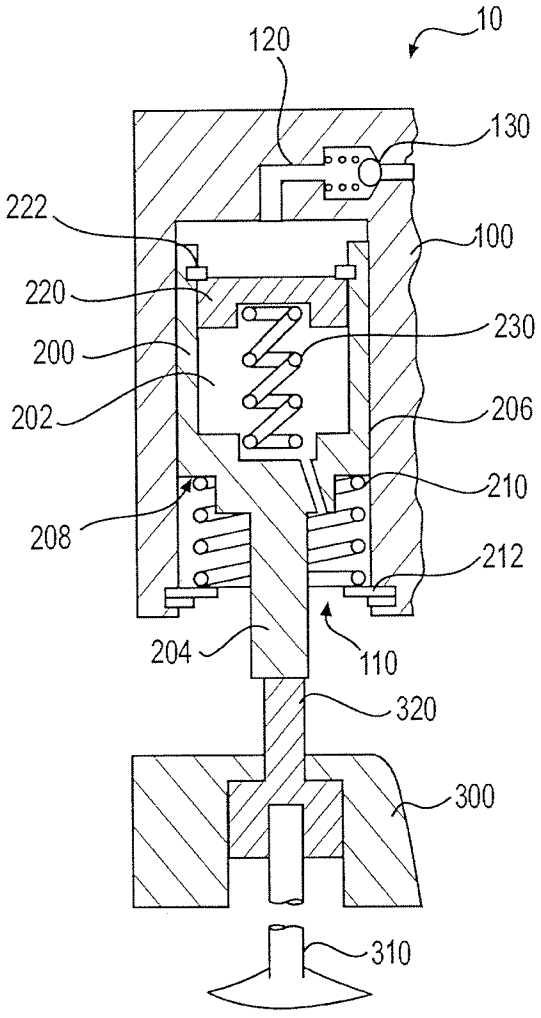
FIGS. 3A-3E are cross-sectional views of a self-lashing hydraulic piston system used to provide bleeder braking and assembled in accordance with first and second embodiments of the present invention.
Figure 3A:
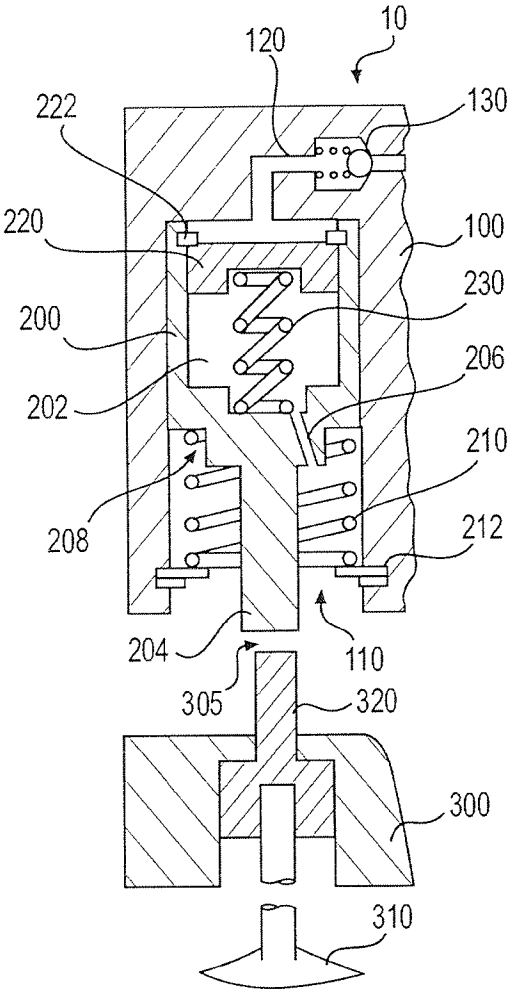

Reference will now be made in detail to an embodiment of the present invention, an example of which is illustrated in the accompanying drawings in FIGS. 3A-3E, which is also schematically illustrated by FIG. 1. With reference to FIG. 3A, a system 10 for actuating engine valves 310 is shown. The system 10 may be used to provide bleeder braking in an internal combustion engine, or compression release engine braking alone or in combination with other auxiliary engine valve events, such as brake gas recirculation events. However, the system 10 is not limited to these uses or providing only these valve events.

With reference to FIG. 3A, when used for bleeder braking, the system 10 may include a fixed overhead housing 100 mounted above one of the engine valves 310, and the engine valves (only one of two engine valves connected with a valve bridge 300 is shown) may be exhaust valves. The housing 100 may include a bore 110 and a hydraulic fluid supply passage 120. A check valve 130, of any type, may be provided in the hydraulic fluid supply passage 120 in a manner that prevents hydraulic fluid supplied to the bore 110 from returning to the hydraulic fluid supply. The hydraulic fluid supply may be of a relatively low pressure, for example in the range of 30 to 100 pounds per square inch (psi).

Figure 7:
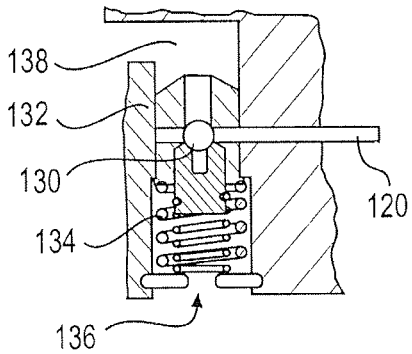
FIG. 7 is a cross-sectional view of a control valve which may be used in various embodiments of the present invention.

With reference to FIG. 7, the check valve 130 may be provided in a control valve piston 132 disposed in a control valve bore 138 formed in the hydraulic fluid supply passage 120. The control valve piston 132 may control the supply of hydraulic fluid to the system 10. The control valve piston 132 may be a cylindrically shaped element with one or more internal passages, and which may incorporate an internal control check valve 130. The check valve 130 may permit fluid to pass from the control valve bore 138 to the hydraulic fluid supply passage 120, but not in the reverse direction. The control valve piston 132 may be spring biased by one or more control valve springs 134 into the control valve bore 138. A central internal passage may extend axially from the inner end of the control valve piston 132 towards the middle of the control valve piston where the control check valve 130 may be located. The central internal passage in the control valve piston 132 may communicate with one or more passages extending across the diameter of the control valve piston.

As a result of translation of the control valve piston 132 relative to its bore 138, the passages extending through the control valve piston 132 may selectively register with a port that connects the side wall of the control valve bore with the hydraulic fluid supply passage 120. When the passages extending through the control valve piston 132 register with the supply fluid passage 120, low pressure fluid may flow from the control valve bore 138, through the control valve piston 132, and into the hydraulic fluid supply passage 120. When low pressure hydraulic fluid supply to the control valve bore 138 is interrupted, the control valve springs 134 push the control valve piston 132 in the bore and hydraulic fluid may vent from the hydraulic fluid supply passage 120 to the ambient.

With renewed reference to FIG. 3A, the hydraulic fluid supply passage 120 communicates with bore 110 which may be sized to receive a self-lashing hydraulic piston 200. The hydraulic piston 200 may include an upper portion in which a piston cavity 202 is formed, and a lower extension 204. An optional vent passage 206 may extend between the piston cavity 202 and the lower portion of the bore 110. A shoulder 208 may be formed below the piston cavity 202, and an external piston spring 210 may be disposed between the shoulder 208 and a lower retaining ring 212. The external piston spring 210 may bias the hydraulic piston 200 into the bore 110 and into contact with the inner end wall of the bore.

A valve bridge 300 may be disposed below the system 10 and include a sliding pin 320 disposed in a cavity formed therein between the system 10 and the exhaust valve 310. The sliding pin 320 may slide relative to the valve bridge 300 so that the exhaust valve 310 may be actuated independently of the valve bridge. When the hydraulic piston 200 contacts the bore 110 end wall and the sliding pin 320 is in its upper most position, as shown in FIG. 3A, a lash space 305 may exist between the piston lower extension 204 and the sliding pin 320. Another valve train element, such as a rocker arm, cam, or push tube (not shown) may act on the valve bridge 300 to actuate two or more exhaust valves simultaneously, independent of the system 10.

A motion absorbing piston 220 may be disposed within the piston cavity 202 such that the motion absorbing piston is capable of sliding into and out of the piston cavity. In a non-preferred embodiment, the motion absorbing piston 220 may also permit some hydraulic fluid to leak past the motion absorbing piston into the interior portion of the piston cavity, although this is not required for operation of the system 10. An inner spring 230 may bias the motion absorbing piston against a stop 222. The bias force of the inner spring 230 may be greater than the force exerted on the motion absorbing piston 220 by a low pressure hydraulic fluid source (not shown). For example, the bias force of the inner spring 230 may be in the range of greater than 50 to 100 psi.

With reference to FIG. 3A, when no bleeder braking is desired, hydraulic fluid supply to the system 10 through the hydraulic fluid supply passage 120 may be interrupted. If no control valve is provided, the system may reset by leak down past the hydraulic piston 200 and/or the reset passage 206. Preferably, hydraulic fluid pressure may vent out of the control valve bore 138 in systems which utilize a check valve within a control valve and which do not require any fluid to leak past the motion absorbing piston. In either case, venting of the hydraulic fluid from the system permits the external piston spring 210 to push the hydraulic piston into contact with the end wall of the bore 110 as shown in FIG. 3A. When bleeder braking is desired, low pressure hydraulic fluid may be supplied to the system 10 via the hydraulic fluid supply passage 120 so that the hydraulic piston 200 translates downward to take up the lash space 305, as shown in FIG. 3B. The pressure of the hydraulic fluid above the hydraulic piston 200 and the motion absorbing piston 220 is not sufficient at this point to overcome the biasing forces of the inner spring 230 or of the exhaust valve 310 return spring (not shown). Accordingly, the supply of low pressure hydraulic fluid to the system 10 only results in elimination of the lash space 305 and does not cause the exhaust valve 310 to open.

Figure 3D:
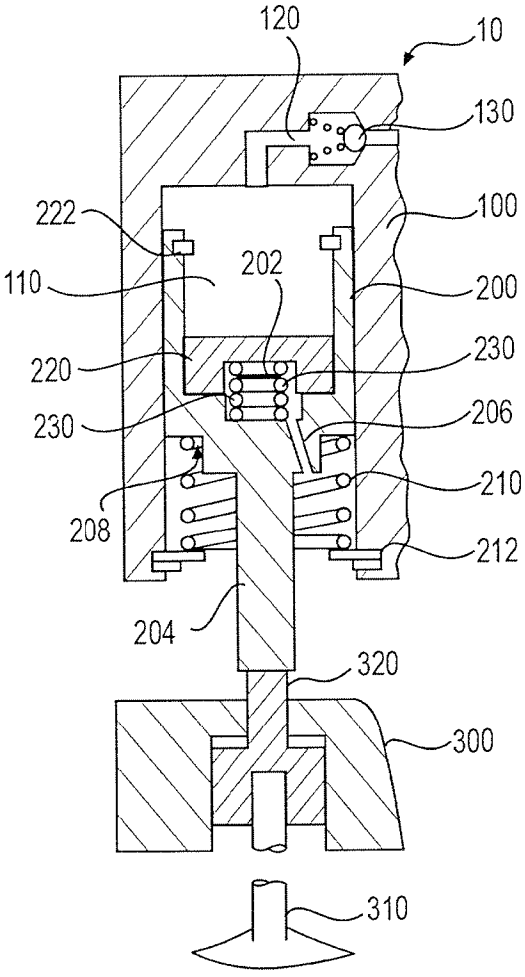
Figure 3C:
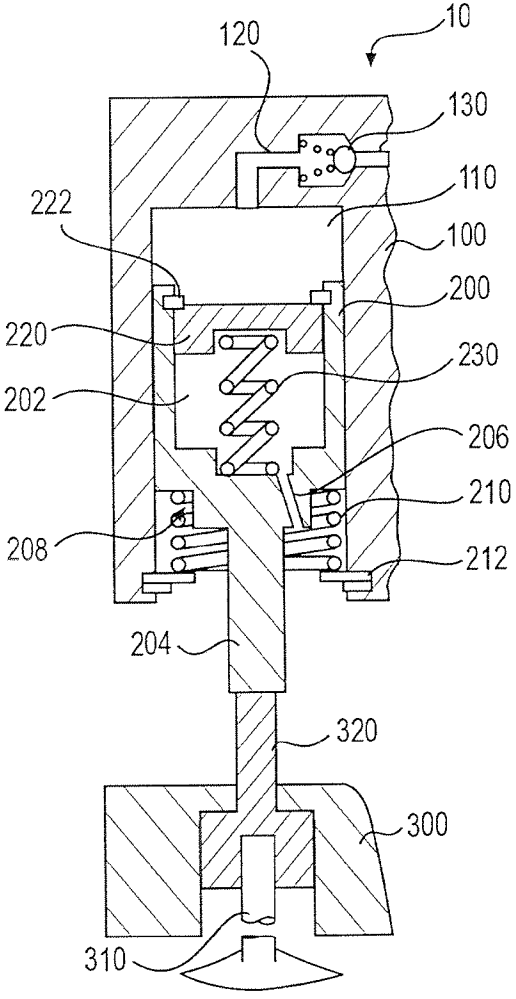

With reference to FIG. 3C, a valve train element, such as a rocker arm, cam, or push tube (shown in FIG. 1 as first valve actuation system 20) acts on the valve bridge 300 so that it translates downward to actuate two or more exhaust valves, including the exhaust valve 310, independent of the system 10. The downward translation of the valve bridge 300 may be for a main exhaust valve actuation event, for example. As the valve bridge 300 translates downward, the hydraulic piston 200 and the sliding pin 320 also translate downward to the same extent and compress the external piston spring 210. As a result of the downward translation of the hydraulic piston 200, low pressure hydraulic fluid fills the portion of the bore 110 above the motion absorbing piston 220. The hydraulic fluid in the upper portion of the bore 110 is trapped therein due to the presence of the check valve 130 which may be disposed in the control valve piston 132. The hydraulic piston 200 reaches its most downward position at the point that the valve bridge 300 is at its most downward position.

With reference to FIG. 3D, the valve bridge 300 and the exhaust valves, including exhaust valve 310, may translate upward due to the upward bias of the exhaust valve springs (not shown) while the main exhaust valve event ends. In turn, the sliding pin 320 and the hydraulic piston 200 are pushed upward by the exhaust valve 310. As the hydraulic piston 200 translates upward, the motion absorbing piston 220 is pushed into the piston cavity 202 because the hydraulic fluid above the motion absorbing piston is locked within the bore 110. The motion absorbing piston 220 eventually seats against the bottom wall of the hydraulic piston 200, compressing the inner spring 230. The shape and size of the hydraulic piston 200 and the motion absorbing piston 220 may be selected such that the volume of hydraulic fluid locked in the upper portion of the bore 110 causes the motion absorbing piston to engage the hydraulic piston before the hydraulic piston seats against the end wall of the bore, as shown in FIG. 3D. When the system 10 reaches the position shown in FIG. 3D, the hydraulic piston 200 can not move upward any further and, in turn, the sliding pin 320 can not move upward any further. As a result, the exhaust valve 310 remains slightly cracked open, as indicated by the open space between the sliding pin 320 and the valve bridge 300 cavity end wall. This slight opening of the exhaust valve 310, for example in the range of 0.5-3 mm, may provide bleeder braking. When bleeder braking is no longer desired, hydraulic fluid supply to the bore 110 may be interrupted, which permits the hydraulic fluid in the system 10 to leak down past the hydraulic piston 200 and/or past the motion absorbing piston 220 and through the vent passage 206 or, alternatively, in embodiments which use a control valve piston 132 and do not require fluid to leak past the motion absorbing piston, hydraulic fluid may vent from the hydraulic fluid supply passage 120 to ambient (see FIG. 7).

Figure 3E:
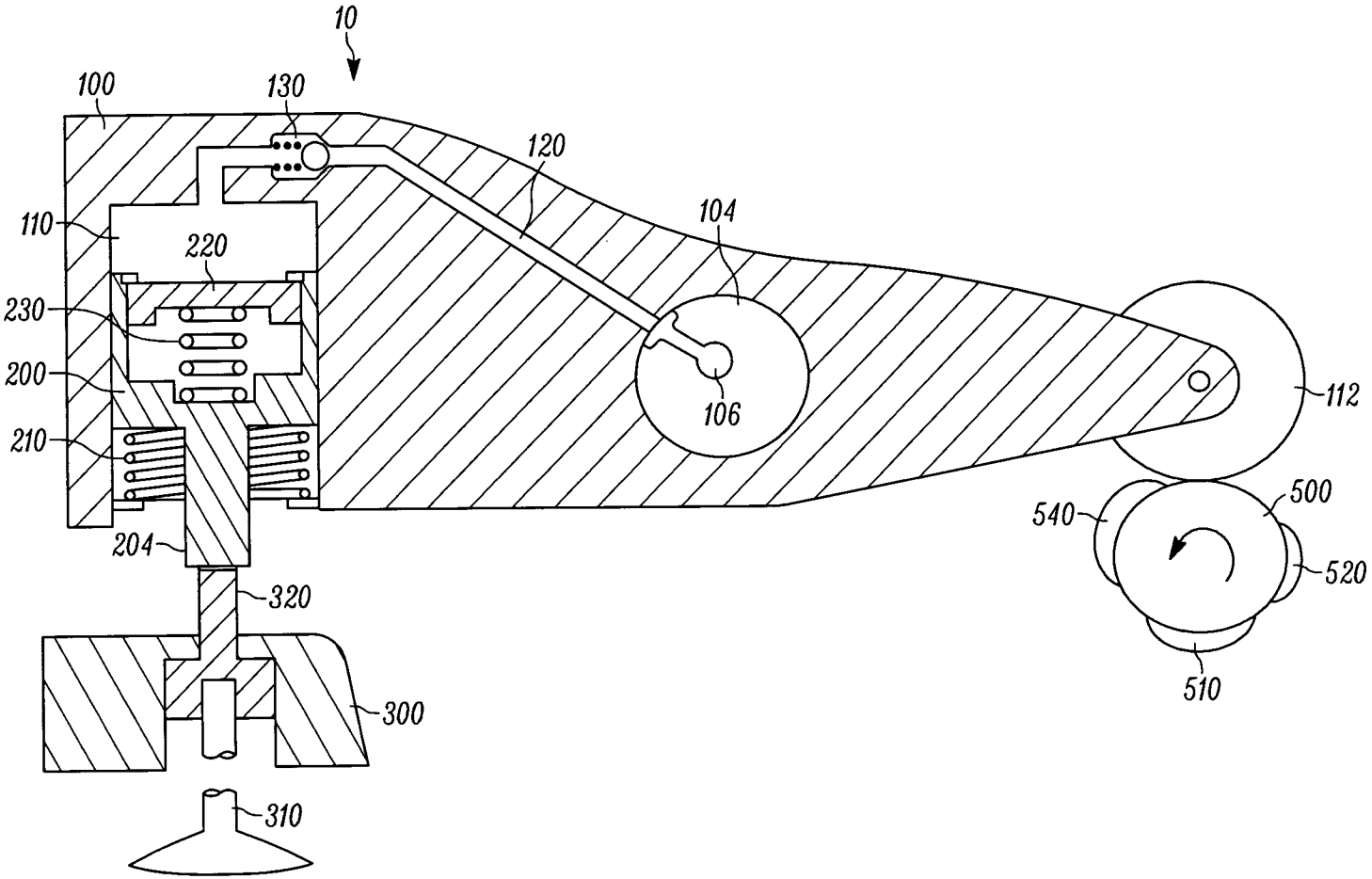

With renewed reference to FIGS. 3A-3D, and additionally to FIG. 3E, the system 10 may also be used to provide compression release engine braking, alone or in combination with other auxiliary valve actuation events. When used for compression release engine braking, a dedicated engine braking rocker arm may comprise the housing 100, as shown in FIG. 3E. Low pressure hydraulic fluid may be supplied to the system 10 via one or more passages 106 provided in the rocker arm, including, but not necessarily limited to hydraulic fluid supply passage 120. The system 10, when provided in a rocker arm as the housing 100, as shown in FIG. 3E, may be similar to the system 10 shown in FIGS. 3A-3D in all other respects.

With reference to FIGS. 3A and 3E, when no compression release engine braking is desired, hydraulic fluid supply to the system 10 through the hydraulic fluid supply passage 120 may be interrupted. As a result, hydraulic fluid pressure in the system leaks down past the hydraulic piston 200 and/or through the vent passage 206 so that the external piston spring 210 pushes the hydraulic piston into contact with the end wall of the bore 110, as shown in FIG. 3A. Alternatively, hydraulic fluid pressure may vent out of the control valve bore 138 in systems which utilize a check valve within a control valve, and which do not require fluid to leak past the motion absorbing piston.

When compression release engine braking is desired, low pressure hydraulic fluid may be supplied to the system 10 via the hydraulic fluid supply passage 120 so that the hydraulic piston 200 translates downward to take up the lash space 305, as shown in FIG. 3B. The pressure of the hydraulic fluid above the hydraulic piston 200 and the motion absorbing piston 220 is not sufficient at this point to overcome the biasing forces of the inner spring 230 or of the external piston spring 210 in combination with the biasing force of the exhaust valve 310 return spring (not shown). Accordingly, the supply of low pressure hydraulic fluid to the system 10 only results in elimination of the lash space 305 and may not cause the exhaust valve 310 to open.

With reference to FIGS. 3C and 3E, a valve train element, such as a rocker arm, cam, or push tube (shown in FIG. 1 as first valve actuation system 20) acts on the valve bridge 300 so that it translates downward to actuate two or more exhaust valves, including the exhaust valve 310, independent of the system 10. The downward translation of the valve bridge 300 may be for a main exhaust valve actuation event, for example. As the valve bridge 300 translates downward, the hydraulic piston 200 and the sliding pin 320 also translate downward to the same extent and compress the external piston spring 210. As a result of the downward translation of the hydraulic piston 200, low pressure hydraulic fluid fills the portion of the bore 110 above the motion absorbing piston 220. The hydraulic fluid in the upper portion of the bore 110 is trapped therein due to the presence of the check valve 130 which may be disposed in a control valve. The hydraulic piston 200 reaches its most downward position at the point that the valve bridge 300 is at its most downward position.

With reference to FIG. 3E, at the same time that the valve bridge 300 is translated downward for the main valve event, such as main exhaust, the rocker arm housing 100 may be pivoted by an optional main event follow lobe 540 on the cam 500 to reduce the hydraulic volume required in bore 110 and reduce the overall size of the device. The size and design of the main event follow lobe 540 should permit the rocker arm housing 100 and the hydraulic piston 200 contained therein to follow the valve bridge 300 at a constant maximum differential position through a sufficient amount of the main valve event to permit refill of the portion of the bore 110 above the motion absorbing piston 220. For example, the main event follow lobe 540 may match the lift of the main event valve lift for the first and last 10-50 cam angle degrees of the main valve event. It is preferable to design the main event follow lobe 540 to dwell for 20-100 cam angle degrees of the main valve event centered around peak lift to permit adequate refill before returning to cam base circle.

With reference to FIGS. 3D and 3E, the valve bridge 300 and the exhaust valves, including exhaust valve 310, may translate upward due to the upward bias of the exhaust valve springs (not shown) while the main exhaust valve event ends. In turn, the sliding pin 320 and the hydraulic piston 200 are pushed upward by the exhaust valve 310. As the hydraulic piston 200 translates upward, the motion absorbing piston 220 is pushed into the piston cavity 202 because the hydraulic fluid above the motion absorbing piston is locked within the bore 110. The motion absorbing piston 220 eventually seats against the bottom wall of the hydraulic piston 200, compressing the inner spring 230. The shape and size of the hydraulic piston 200 and the motion absorbing piston 220 may be selected such that the volume of hydraulic fluid locked in the upper portion of the bore 110 causes the motion absorbing piston to engage the hydraulic piston just as the exhaust valve 310 seats or slightly thereafter.

With reference to FIG. 3E, subsequent rotation of the cam 500, causes the first auxiliary lobe 510, such as a compression release brake bump, and the one or more optional auxiliary cam bumps 520, to pivot the rocker arm 100 and open the exhaust valve 310 for a compression release valve event, and one or more optional auxiliary exhaust valve events. When compression release engine braking is no longer desired, hydraulic fluid supply to the bore 110 may be interrupted, which permits the hydraulic fluid in the system 10 to leak down past the hydraulic piston 200 and/or past the motion absorbing piston 220 and through the vent passage 206. Alternatively, hydraulic fluid pressure may vent out of the control valve bore 138 in systems which utilize a check valve within a control valve, and which do not require any fluid to leak past the motion absorbing piston.

With reference to FIGS. 4A-4D, in another embodiment of the present invention, a system 10 for actuating engine valves 310 is shown which is also schematically illustrated by FIG. 1. The system 10 may be used to provide compression-release engine braking in an internal combustion engine, alone or in combination with other auxiliary engine valve events, such as brake gas recirculation events. However, the system 10 is not limited to these uses or to providing only these valve events.

The system 10 may include a fixed overhead housing 100 mounted above one of the engine valves 310, and the engine valves (only one of two engine valves connected with a valve bridge 300 is shown) may be exhaust valves. The housing 100 may include a bore 110 and a hydraulic fluid supply passage 120. A check valve 130, of any type, may be provided in the hydraulic fluid supply passage 120 in a manner that prevents hydraulic fluid supplied to the bore 110 from returning to the hydraulic fluid supply. The hydraulic fluid supply may be of a relatively low pressure, for example in the range of 30 to 100 pounds per square inch (psi).

As noted above with reference to FIG. 7, the check valve 130 may be provided in a control valve piston 132 disposed in a control valve bore 138 formed in the hydraulic fluid supply passage 120. The operation of the control valve is discussed above.

With renewed reference to FIGS. 4A-4D, the bore 110 may be sized to receive a self-lashing hydraulic piston 200. The hydraulic piston 200 may include an upper portion in which a piston cavity 202 is formed, and a lower extension 204. A vent passage 206 may extend between the piston cavity 202 and the lower portion of the bore 110. A shoulder 208 may be formed below the piston cavity 202, and an external piston spring 210 may be disposed between the shoulder 208 and a lower retaining ring 212. The external piston spring 210 may bias the hydraulic piston 200 into the bore 110 and into contact with the inner end wall of the bore.

A valve bridge 300 may be disposed below the system 10 and include a sliding pin 320 disposed in a cavity formed therein between the system 10 and the exhaust valve 310. The sliding pin 320 may slide relative to the valve bridge 300 so that the exhaust valve 310 may be actuated independently of the valve bridge. When the hydraulic piston 200 contacts the bore 110 end wall and the sliding pin 320 is in its upper most position, as shown in FIG. 3A, a lash space 305 may exist between the piston lower extension 204 and the sliding pin 320. Another valve train element, such as a rocker arm, cam, or push tube (not shown) may act on the valve bridge 300 to actuate two or more exhaust valves simultaneously, independent of the system 10.

A motion absorbing piston 220 may be disposed within the piston cavity 202 such that the motion absorbing piston is capable of sliding into and out of the piston cavity. An inner spring 230 may bias the motion absorbing piston against a stop 222. The bias force of the inner spring 230 may be greater than the force exerted on the motion absorbing piston 220 by a low pressure hydraulic fluid source (not shown). For example, the bias force of the inner spring 230 may be in the range of greater than 50 to 100 psi.

Figure 8:
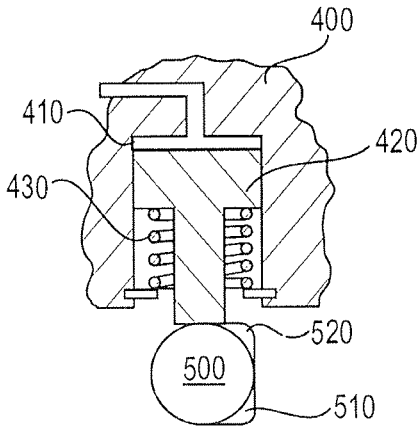
FIG. 8 is a cross-sectional view of an alternative master piston that may be used in connection with the system shown in FIGS. 4A-4D.

The hydraulic fluid supply passage 120 may be connected by a master piston hydraulic passage 440 to a master piston bore 410 provided in a master piston housing 400. A master piston 420 may be disposed in the master piston bore 410 and biased by a master piston spring 430 either into contact with a master piston cam 500 or biased away from the cam and into the bottom of the master piston bore so that when low pressure hydraulic fluid is applied to the circuit, the master piston extends into contact with the cam (see FIG. 8). The master piston cam may have one or more auxiliary engine valve actuation lobes, including for example, an compression-release lobe 510, a brake gas recirculation lobe 520, and a main event follow lobe 540. The lobes 510, 520 and 540 may act on the master piston 420 to slide it in and out of the master piston bore 410, which in turn may provide hydraulic actuation of the hydraulic piston 200 for auxiliary engine valve events, such as compression-release engine braking.

Figure 4B:
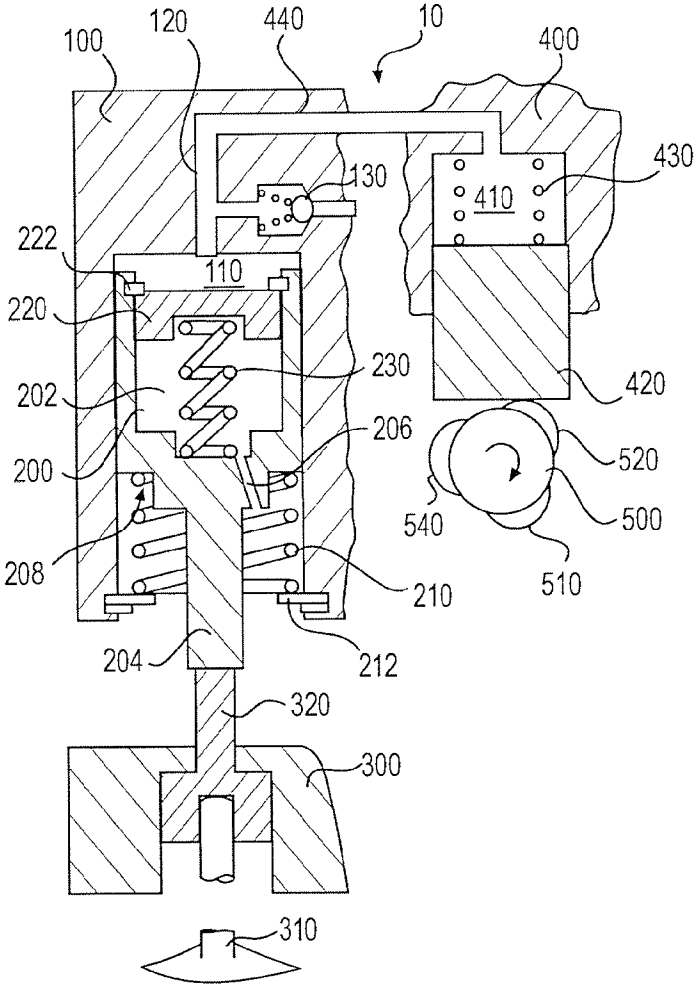
FIGS. 4A-4D are cross-sectional views of a self-lashing hydraulic piston and dedicated engine braking cam system used to provide engine braking and assembled in accordance with a third embodiment of the present invention.
Figure 4A:
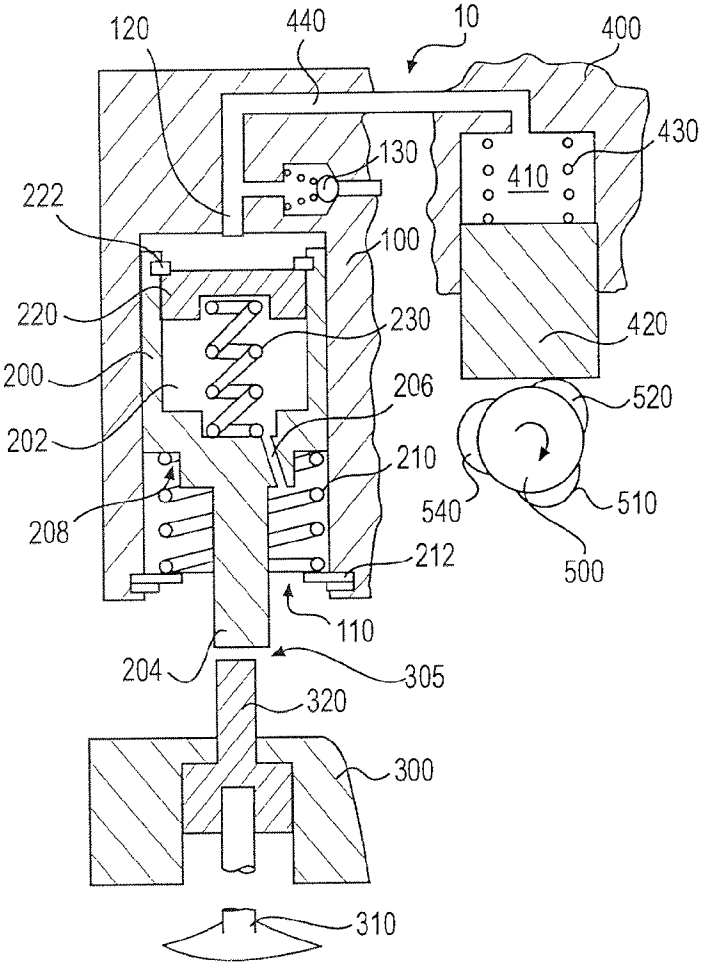

With reference to FIG. 4A, when the system 10 is used for compression-release engine braking, but no engine braking is yet desired (i.e., during positive power operation or at engine start up), hydraulic fluid supply to the system 10 through the hydraulic fluid supply passage 120 may be interrupted. As a result, hydraulic fluid pressure in the system 10 leaks down past the hydraulic piston 200 and/or through the vent passage 206 so that the external piston spring 210 pushes the hydraulic piston into contact with the end wall of the bore 110, as shown in FIG. 4A. Alternatively, in embodiments which use a control valve piston 132 and which do not require any fluid to leak past the motion absorbing piston, hydraulic fluid may vent from the hydraulic fluid supply passage 120 to ambient (see FIG. 7). When compression release engine braking is desired, low pressure hydraulic fluid may be supplied to the system 10 via the hydraulic fluid supply passage 120 so that the hydraulic piston 200 translates downward to take up the lash space 305, as shown in FIG. 4B. Hydraulic fluid may also be provided to the master-piston bore 410 via the master piston hydraulic fluid passage 440. The pressure of the hydraulic fluid above the hydraulic piston 200 and the motion absorbing piston 220 is not sufficient at this point to overcome the biasing forces of the inner spring 230 or of the exhaust valve 310 return spring (not shown). Accordingly, the supply of low pressure hydraulic fluid to the system 10 only results in elimination of the lash space 305 and may not cause the exhaust valve 310 to open, as shown in FIG. 4B.

Figure 4D:
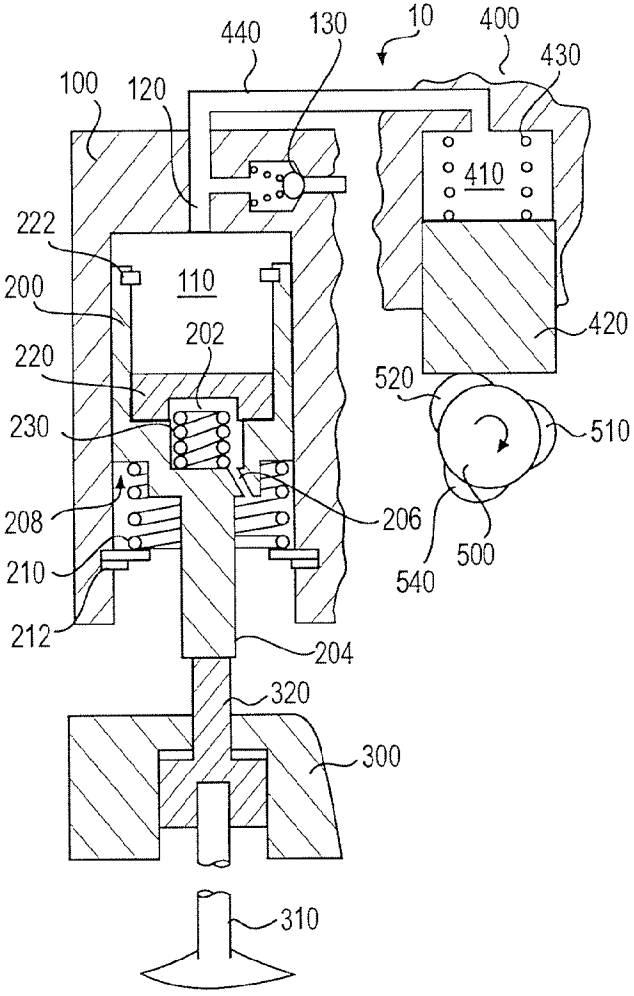
Figure 4C:
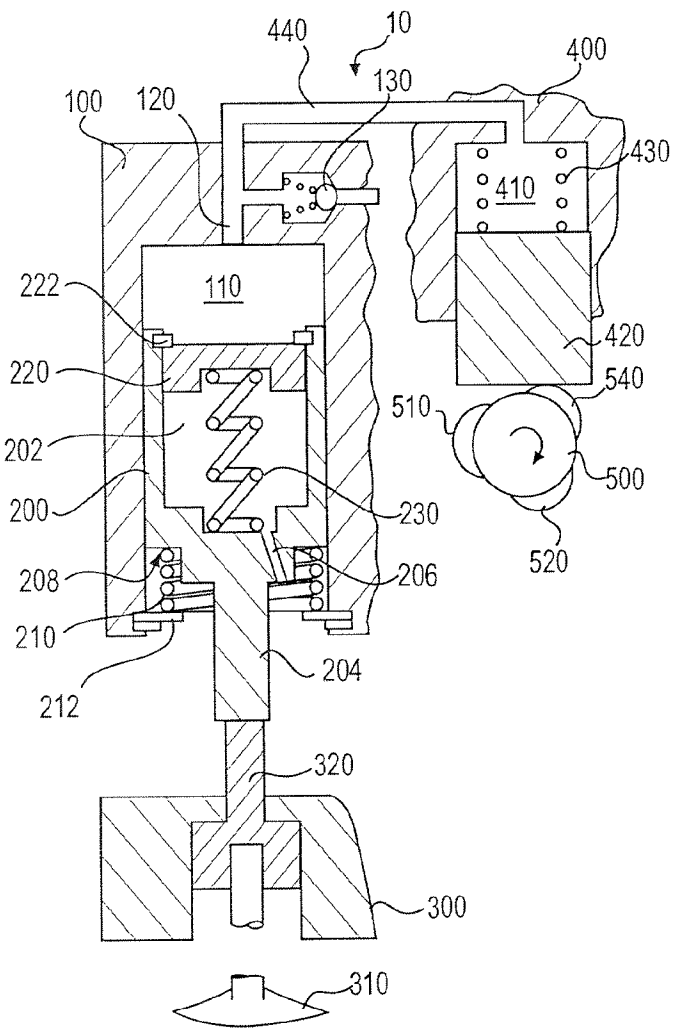

With reference to FIG. 4C, a valve train element, such as a rocker arm, cam, or push tube (shown in FIG. 1 as first valve actuation system 20) acts on the valve bridge 300 so that it translates downward to actuate two or more exhaust valves, including the exhaust valve 310, independent of the system 10. The downward translation of the valve bridge 300 may be for a main exhaust valve actuation event, for example. As the valve bridge 300 translates downward, the hydraulic piston 200 and the sliding pin 320 also translate downward to the same extent and compress the external piston spring 210. As a result of the downward translation of the hydraulic piston 200, low pressure hydraulic fluid fills the portion of the bore 110 above the motion absorbing piston 220. The hydraulic fluid in the upper portion of the bore 110 is trapped therein due to the presence of the check valve 130 which may be disposed within a control valve. The hydraulic piston 200 reaches its most downward position at the point that the valve bridge 300 is at its most downward position.

At the same time that the valve bridge 300 is translated downward for the main valve event, such as main exhaust, the master piston 420 may be pushed inward by an optional main event follow lobe 540 on the cam 500. The design, operation and purpose of the main event follow lobe 540 are discussed above. The size and design of the cam lobe 540 should permit the master piston 420 and the hydraulic piston 200 hydraulically linked thereto to follow the valve bridge 300 at a constant maximum differential position through a sufficient amount of the main valve event to permit refill of the portion of the bore 110 above the motion absorbing piston 220.

With reference to FIG. 4D, the valve bridge 300 and the exhaust valves, including exhaust valve 310, may translate upward due to the upward bias of the exhaust valve springs (not shown) while the main exhaust valve event ends. In turn, the sliding pin 320 and the hydraulic piston 200 are pushed upward by the exhaust valve 310. As the hydraulic piston 200 translates upward, the motion absorbing piston 220 may be pushed into the piston cavity 202 because the hydraulic fluid above the motion absorbing piston is locked within the bore 110. The motion absorbing piston 220 eventually seats against the bottom wall of the hydraulic piston 200, compressing the inner spring 230. The shape and size of the hydraulic piston 200 and the motion absorbing piston 220 may be selected such that the volume of hydraulic fluid locked in the upper portion of the bore 110 causes the motion absorbing piston to engage the hydraulic piston just as the exhaust valve 310 seats or slightly thereafter.

Subsequent rotation of the cam 500, causes the first auxiliary event bump 510, such as a compression release brake bump, and the one or more optional auxiliary cam bumps 520, to push the master piston 420 into the master piston bore 410 which displaces a sufficient amount of hydraulic fluid in the circuit to open the exhaust valve 310 for a compression release valve event, and one or more optional auxiliary exhaust valve events. When compression release engine braking is no longer desired, hydraulic fluid supply to the bore 110 may be interrupted, which permits the hydraulic fluid in the system 10 to leak down past the hydraulic piston 200 and/or past the motion absorbing piston 220 and through the vent passage 206. Alternatively, in embodiments which use a control valve piston 132, hydraulic fluid may vent from the hydraulic fluid supply passage 120 to ambient (see FIG. 7).

Figure 10:
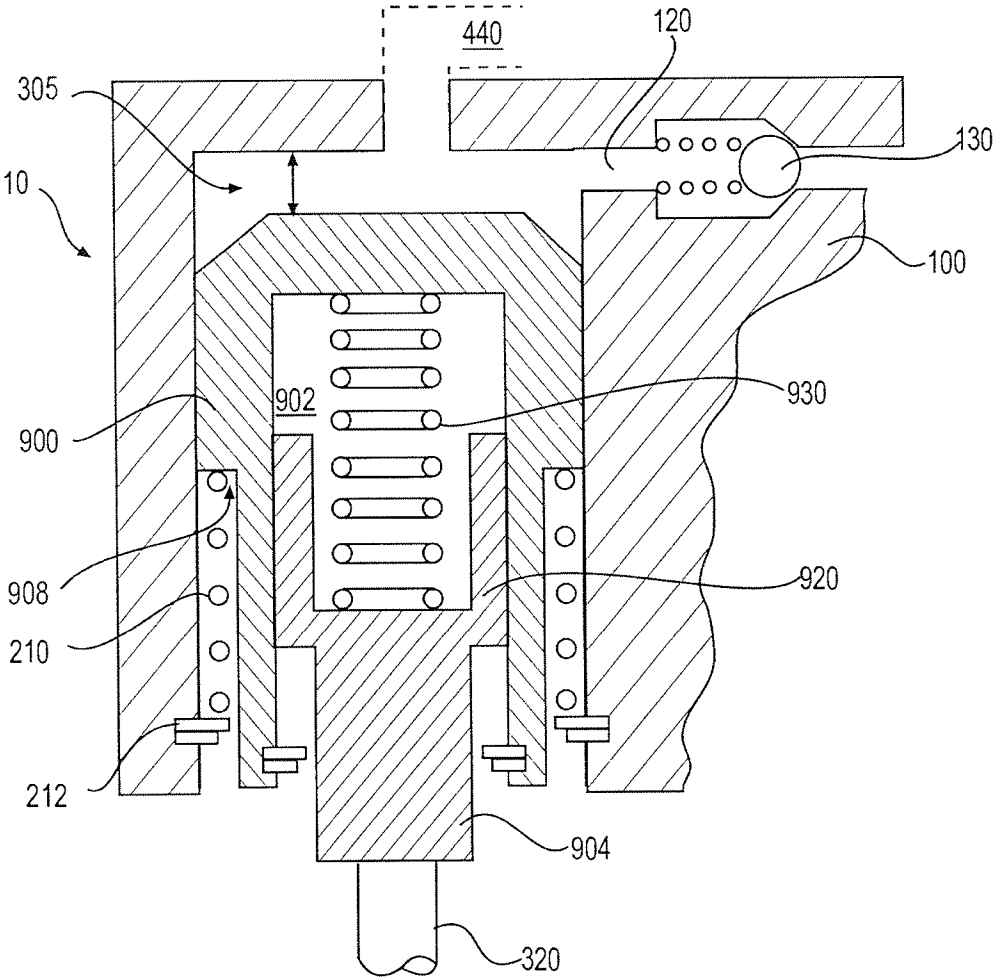
FIG. 10 is a cross-sectional view of an alternative valve actuation system that may be used in connection with the FIGS. 3A-3E and 4A-4D embodiments of the present invention.

In alternative embodiments of the invention, in which like reference numerals refer to like elements, the hydraulic piston and motion absorbing piston assemblies shown in FIGS. 3A-3E and 4A-4D may be replaced with the hydraulic piston 900 and motion absorbing piston 920 assembly shown in FIG. 10. With reference to FIGS. 3A-3E, 4A-4D and 10, the system 10 may be disposed in a fixed overhead housing or rocker arm 100 mounted above one of the engine valves 310, and the engine valves (only one of two engine valves connected with a valve bridge 300 is shown) may be exhaust valves. The housing 100 may include a bore 110 and a hydraulic fluid supply passage 120. A check valve 130 may be provided in the hydraulic fluid supply passage 120 in a manner that prevents hydraulic fluid supplied to the bore 110 from returning to the hydraulic fluid supply. The hydraulic fluid supply may be of a relatively low pressure, for example in the range of 30 to 100 pounds per square inch (psi). In an alternative embodiment, the hydraulic fluid supply passage 120 may be connected by a master piston hydraulic passage 440 to a master piston bore 410 provided in a master piston housing 400 as explained in connection with FIGS. 4A-4D.

The bore 110 may be sized to receive a self-lashing hydraulic piston 900. The hydraulic piston 900 may include an upper portion in which a piston cavity 902 is formed. A shoulder 908 may be formed along the wall of the hydraulic piston 900, and an external piston spring 210 may be disposed between the shoulder 208 and a lower retaining ring 212. The external piston spring 210 may bias the hydraulic piston 900 into the bore 110 and into contact with the inner end wall of the bore. As discussed above, a valve bridge 300 may be disposed below the system 10 and include a sliding pin 320 disposed in a cavity formed therein between the system 10 and the exhaust valve 310. When the hydraulic piston 900 contacts the bore 110 end wall and the sliding pin 320 is in its upper most position, as shown in FIG. 10, a lash space 305 may exist between the piston lower extension 904 and the sliding pin 320. Another valve train element, such as a rocker arm, cam, or push tube (not shown) may act on the valve bridge 300 to actuate two or more exhaust valves simultaneously, independent of the system 10.

A motion absorbing piston 920 may be disposed within the piston cavity 902 such that the motion absorbing piston is capable of sliding into and out of the piston cavity. An inner spring 930 may bias the motion absorbing piston 920 towards the sliding pin 320. The bias force of the inner spring 930 may be greater than the force exerted on the hydraulic piston 900 by a low pressure hydraulic fluid source (not shown) through passage 120. For example, the bias force of the inner spring 930 may be in the range of greater than 50 to 100 psi.

With continued reference to FIG. 10, when no bleeder braking is desired, hydraulic fluid supply to the system 10 through the hydraulic fluid supply passage 120 may be interrupted. As a result, hydraulic fluid pressure may vent out of the control valve bore 138 in systems which utilize a check valve within a control valve (discussed above). When bleeder braking is desired, low pressure hydraulic fluid may be supplied to the system 10 via the hydraulic fluid supply passage 120 so that the hydraulic piston 900 translates downward to take up the lash space. The pressure of the hydraulic fluid above the hydraulic piston 900 and the motion absorbing piston 920 is not sufficient at this point to overcome the biasing forces of the inner spring 930 or the exhaust valve 310 return spring (not shown). Accordingly, the supply of low pressure hydraulic fluid to the system 10 does not cause the exhaust valve 310 to open.

A valve train element, such as a rocker arm, cam, or push tube (shown in FIG. 1 as first valve actuation system 20) acts on the valve bridge 300 so that it translates downward to actuate two or more exhaust valves, including the exhaust valve 310, independent of the system 10. The downward translation of the valve bridge 300 may be for a main exhaust valve actuation event, for example. As the valve bridge 300 translates downward, the hydraulic piston 900 and the sliding pin 320 also translate downward to the same extent and compress the external piston spring 210. As a result of the downward translation of the hydraulic piston 900, low pressure hydraulic fluid fills the portion of the bore 110 above the hydraulic piston 920. The hydraulic fluid in the upper portion of the bore 110 is trapped therein due to the presence of the check valve 130 which may be disposed in the control valve piston 132. The hydraulic piston 200 reaches its most downward position at the point that the valve bridge 300 is at its most downward position.

The valve bridge 300 and the exhaust valves, including exhaust valve 310, may translate upward due to the upward bias of the exhaust valve springs (not shown) as the main exhaust valve event ends. In turn, the sliding pin 320 and the motion absorbing piston 920 are pushed upward by the exhaust valve 310. As the motion absorbing piston 920 translates upward, it is pushed into the piston cavity 902 because the hydraulic fluid above the hydraulic piston 900 is locked within the bore 110. The motion absorbing piston 920 eventually seats against the upper end wall of the hydraulic piston 900, compressing the inner spring 930.

The shape and size of the hydraulic piston 900 and the motion absorbing piston 920 may be selected such that the volume of hydraulic fluid locked in the upper portion of the bore 110 causes the motion absorbing piston to engage the hydraulic piston before the motion absorbing piston seats against the upper end wall of the hydraulic piston. When the system 10 reaches this position, the motion absorbing piston 900 cannot move upward any further and, in turn, the sliding pin 320 can not move upward any further. As a result, the exhaust valve 310 remains slightly cracked open. This slight opening of the exhaust valve 310, for example in the range of 0.5-3 mm, may provide bleeder braking. When bleeder braking is no longer desired, hydraulic fluid supply to the bore 110 may be interrupted, which permits the hydraulic fluid in the system 10 to vent from the hydraulic fluid supply passage 120 to ambient.

The system shown in FIG. 10 may also be used to provide compression release engine braking, as described in connection with FIGS. 4A-4D.

Reference is now made to another embodiment of the invention, shown in FIGS. 2 and 5A-5E, in which a system 30 for actuating engine valves 310 is illustrated. The system 30 may be used to provide main engine valve actuations (i.e., main intake or main exhaust valve events) in combination with auxiliary valve actuations. The system 30 will be described as used to provide main exhaust valve actuation in combination with compression-release engine braking, alone or in combination with other auxiliary engine valve events, such as brake gas recirculation events. However, it should be noted that the system 30 is not limited to these uses or to providing only these valve events.

Figure 5A:
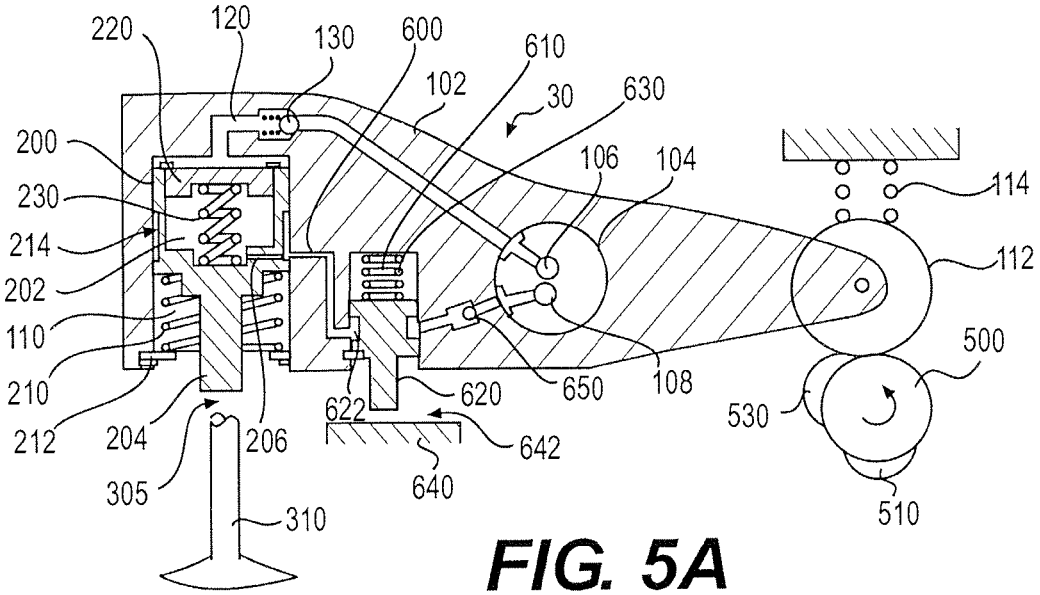
FIGS. 5A-5E are cross-sectional views of a self-lashing hydraulic piston and rocker arm lost motion system used to provide engine braking and assembled in accordance with a fourth embodiment of the present invention.

With reference to FIG. 5A, the system 30 may include a rocker arm 102 which forms a housing for the system. The rocker arm 102 may include a bore 110 and a hydraulic fluid supply passage 120. A check valve 130, of any type, may be provided in the hydraulic fluid supply passage 120 in a manner that prevents hydraulic fluid supplied to the bore 110 from returning to the hydraulic fluid supply. The hydraulic fluid supply may be of a relatively low pressure, for example in the range of 30 to 100 pounds per square inch (psi).

The bore 110 may be sized to receive a self-lashing hydraulic piston 200. The hydraulic piston 200 may include an upper portion in which a piston cavity 202 is formed, and a lower extension 204. The hydraulic piston 200 may further include an annular recess 214 and a vent (or reset) passage 206 which extends between the piston cavity 202 and the annular recess 214. A shoulder may be formed below the piston cavity 202, and an external piston spring 210 may be disposed between the shoulder and a lower retaining ring 212. The external piston spring 210 may bias the hydraulic piston 200 into the bore 110 and into contact with the inner end wall of the bore.

An engine valve 310 may be disposed below the system 30. In the described embodiment, the engine valve 310 is an exhaust valve, however, the invention may be used to actuate intake valves or other engine poppet valves. In alternative embodiments, the engine valve 310 may be one of two or more engine valves which are connected by a valve bridge, as shown in FIG. 2. When the hydraulic piston 200 is in its upper most position and contacts the bore 110 end wall, as shown in FIG. 5A, a lash space 305 may exist between the piston lower extension 204 and the exhaust valve 300.

A motion absorbing piston 220 may be disposed within the piston cavity 202 such that the motion absorbing piston is capable of sliding into and out of the piston cavity while also permitting some hydraulic fluid to leak past the motion absorbing piston into the interior portion of the piston cavity. An inner spring 230 may bias the motion absorbing piston against an upper stop. The bias force of the inner spring 230 may be greater than the force exerted on the motion absorbing piston 220 by a low pressure hydraulic fluid source (not shown). For example, the bias force of the inner spring 230 may be in the range of greater than 50 to 100 psi.

The rocker arm 102 may further include an optional reset piston 620 disposed in a reset bore 610 adjacent to the bore 110. The bore 110 and the reset bore 610 may be connected by a reset passage 600. The reset piston 620 may include a lower extension and a reset piston annular recess 622. A reset spring 630 may bias the reset piston 620 into contact with a lower stop. A reset lash space 642 may exist between the reset piston lower extension and a surface 640 when the cam 500 is at base circle, as shown in FIG. 5A. A fill passage, including a check valve 650, may extend from the reset bore 610 to a rocker shaft 104. The check valve 650 may permit flow of hydraulic fluid in only one direction, from the rocker shaft to the reset bore 610. Both the hydraulic piston annular recess 214 and the reset piston annular recess 622 may be sized to selectively register with the reset passage 600 when the reset piston 620 is in its lower most position. It should be noted that, while the reset passage 600 is schematically shown to have multiple bends for ease of illustration, in a preferred embodiment the reset passage may extend directly between the bore 110 and the reset bore 610 for ease of manufacturing.

The rocker arm 102 may be pivotally mounted on the rocker shaft 104. First and second rocker shaft hydraulic fluid supply passages 106 and 108 may be provided in the rocker shaft. The first rocker shaft hydraulic fluid supply passage 106 may register with the hydraulic fluid supply passage 120 which communicates with the bore 110. The second rocker shaft hydraulic fluid supply passage 108 may register with the fill passage containing the check valve 650.

The rocker arm may further include a cam roller 112 which is biased by a rear spring 114 into contact with a cam, in this instance and exhaust cam 500. The exhaust cam 500 may include a main exhaust lobe 530 and a compression-release engine braking lobe 510 as well as other valve motion events.

With reference to FIG. 5A, when the system 30 is used for positive power and compression-release engine braking, but the engine is in a cold, non-running, state, hydraulic fluid supply to the system 30 through the first and second rocker shaft hydraulic fluid supply passages 106 and 108, and through the hydraulic fluid supply passage 120 may be interrupted. As a result, hydraulic fluid pressure in the system 30 will be at a minimum after leaking down past the hydraulic piston 200 and/or through the vent passage 206 past the reset piston 610, or as a result of opening control valve 130. As a result, the external piston spring 210 pushes the hydraulic piston 200 into contact with the upper end wall of the bore 110, as shown in FIG. 5A.

Figure 5B:
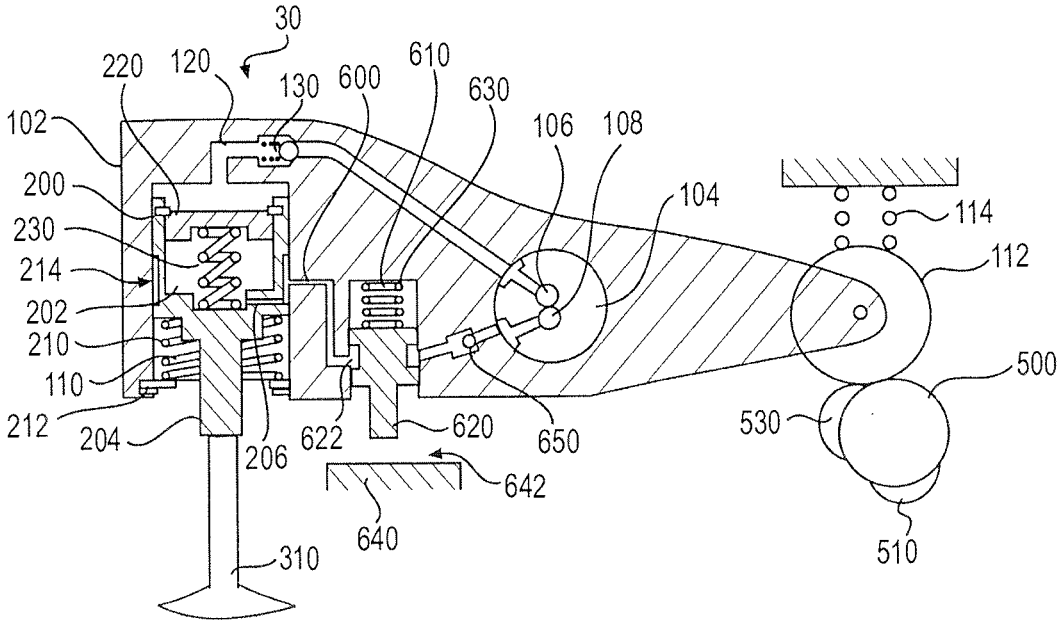

When positive power operation of the engine is desired, low pressure hydraulic fluid may be supplied to the system 30 via the first rocker shaft hydraulic fluid supply passage 106 and the hydraulic fluid supply passage 120 so that the hydraulic piston 200 translates downward to take up the lash space 305, as shown in FIG. 5B. At this time, hydraulic fluid is not supplied to the second rocker shaft hydraulic fluid supply passage 108 and, as a result, the reset piston 620 remains in its lower most position. The pressure of the hydraulic fluid above the hydraulic piston 200 and the motion absorbing piston 220 is not sufficient at this point to overcome the biasing forces of the inner spring 230 or of the external piston spring 210 in combination with the biasing force of the exhaust valve 310 return spring (not shown). Accordingly, the supply of low pressure hydraulic fluid to the system 30 only results in elimination of the lash space 305 and may not cause the exhaust valve 310 to open, as shown in FIG. 5B.

Figure 5C:
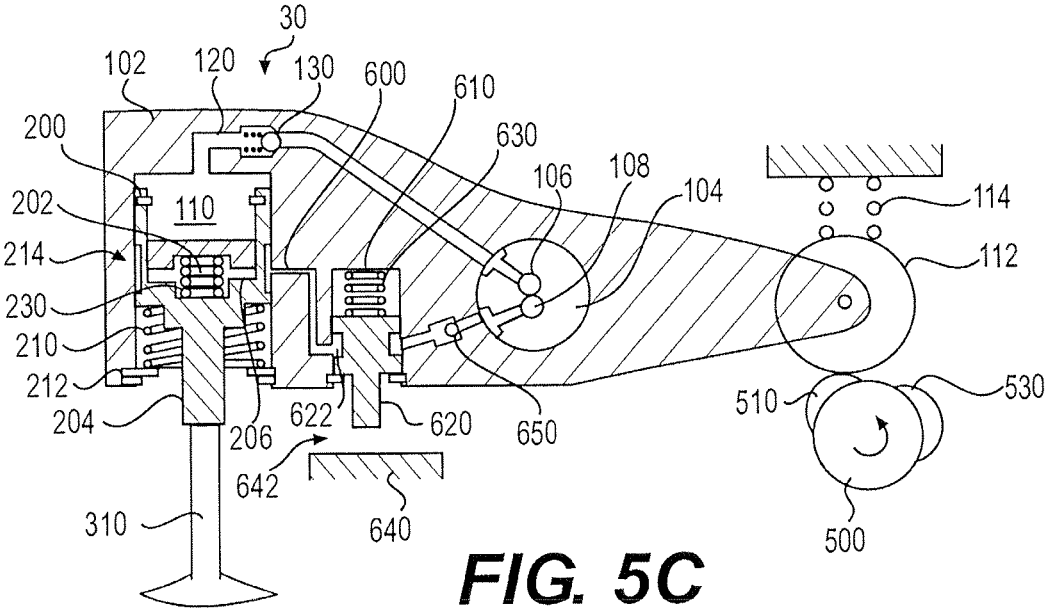

With reference to FIG. 5C, during positive power operation, the cam 500 rotates such that a pivoting motion is applied to the rocker arm 102 by the compression-release lobe 510 and the main exhaust lobe 530 as well as other valve motion events. The height of the main exhaust lobe exceeds that of the compression-release lobe. When the rocker arm 102 is pivoted by the compression-release lobe 510, the end of the rocker arm that is proximal to the exhaust valve 310 translates downward toward the exhaust valve. Because the bias force of the inner spring 230 is less than the combined biasing forces of the external piston spring 210 and the exhaust valve spring (not shown), the pivoting motion imparted to the rocker arm 102 by the compression-release lobe 510 causes the motion absorbing piston 220 to be pushed into the piston cavity 202, resulting in the compression-release motion being absorbed by the motion absorbing piston. The shape and size of the hydraulic piston 200 and the motion absorbing piston 220 may be selected such that the motion absorbing piston 220 seats against the bottom wall of the hydraulic piston 200 when the maximum amount of pivoting motion is applied to the rocker arm 102 by the compression-release lobe 510, as shown in FIG. 5C. As the rocker arm pivots back during the later portion of the compression-release motion, the motion absorbing piston 220 may reset to the position shown in FIG. 5B.

With continued reference to FIG. 5C, continued rotation of the cam 500, causes the rocker arm 102 to next pivot in response to the main exhaust lobe 530. During the initial portion of the main exhaust pivoting motion, the motion absorbing piston 220 once again is pushed into the piston cavity 202 until it seats against the bottom wall of the hydraulic piston 200. However, because the height of the main exhaust lobe 530 exceeds the height of the compression-release lobe 510, the hydraulic piston 200, which is locked into position by the presence of hydraulic fluid in the upper portion of the bore 110, moves downward with the head of the rocker arm 102 and actuates the exhaust valve 310 for a main exhaust valve event. The process described in the preceding two paragraphs continues during positive power operation of the engine.

Figure 5D:
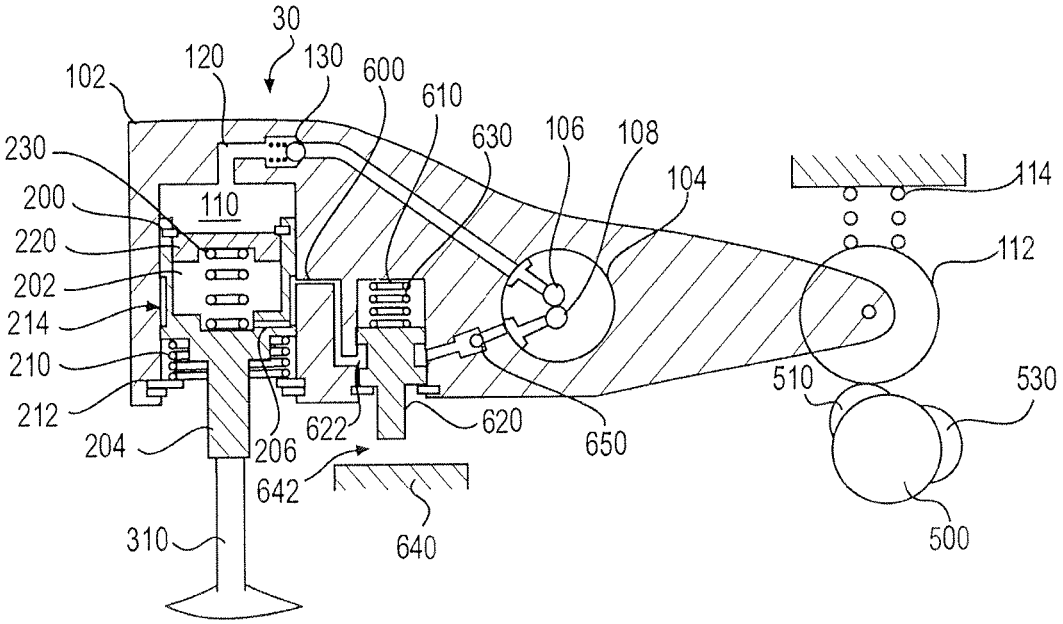

With reference to FIG. 5D, during compression-release engine braking, low pressure hydraulic fluid is provided to the second rocker shaft hydraulic fluid supply passage 108. This hydraulic fluid flows past the check valve 650, through the annular recess 622 of the reset piston 620, the reset passage 600, the hydraulic piston annular recess 214 and the vent passage 206 to the piston cavity 202. The provision of the hydraulic fluid to the piston cavity 202 causes the motion absorbing piston 220 to be hydraulically locked into its upper most position, as shown in FIG. 5D. When so hydraulically locked, the combination of the motion absorbing piston 220 and the hydraulic piston 200 transfer the full pivoting motion of the compression-release lobe 510 to the exhaust valve 310. As a result, the system 30 actuates the exhaust valve (or valves as shown in FIG. 2) for compression-release engine braking.

Figure 5E:
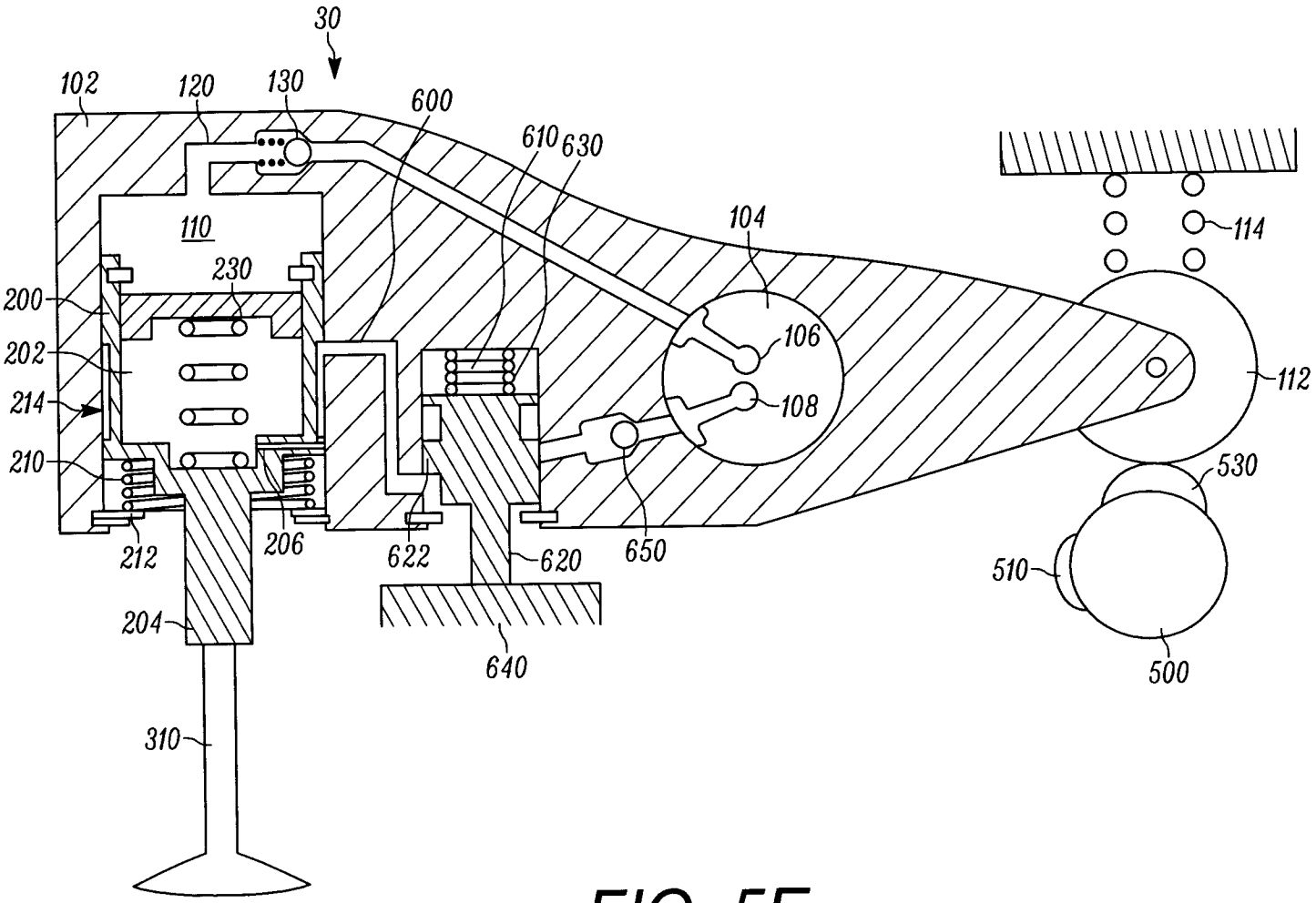
Figure 6:
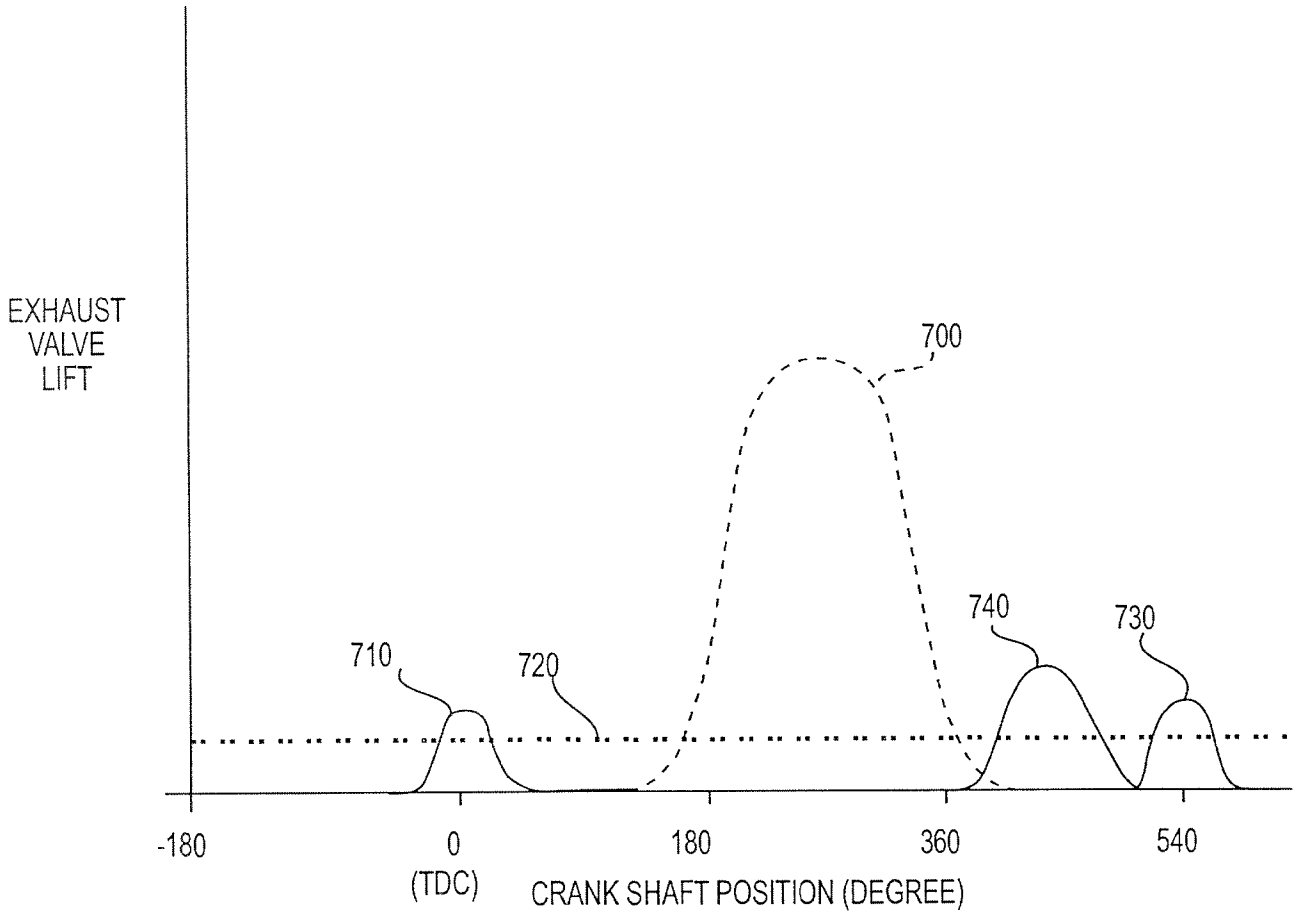
FIG. 6 is a graph of a number of different and exemplary auxiliary valve events.

With reference to FIG. 5E, during compression-release engine braking, when the rocker arm 102 is pivoted in response to the main exhaust lobe 530, the magnitude of the pivoting motion may cause the reset piston 620 to engage the surface 640 and push the reset piston upward into its bore until the reset piston unblocks the reset passage 600, allowing it to vent to an ambient. The magnitude of the pivoting motion required to cause the reset piston 620 to engage surface 640 should be more than the amount of pivoting motion required for the compression-release event, but less than the amount of motion required for actuation of the engine valves for the main exhaust event. Venting of the reset passage 600 causes the hydraulic fluid pressure in the piston cavity 202 to vent and the hydraulic piston 200 translates upward and collapse against the motion absorbing piston 220 (see FIG. 5C). As a result, the actuation of the exhaust valve 310 is reduced by the amount of motion absorbing piston travel, which is also the height of the compression-release cam lobe 510, and the system 30 resets for the next compression-release and main exhaust events.

It will be apparent to those skilled in the art that variations and modifications of the present invention can be made without departing from the scope or spirit of the invention. It is intended that the present invention cover all such modifications and variations of the invention, provided they come within the scope of the appended claims and their equivalents.

What is claimed is:

1. A system for hydraulic lash adjustment and engine valve actuation comprising:

a housing disposed above an engine valve train element, said housing having a piston bore and a hydraulic fluid supply passage communicating with the piston bore;

a hydraulic piston slidably disposed in the piston bore, said hydraulic piston having an internal cavity;

a motion absorbing piston slidably disposed in the hydraulic piston internal cavity;

a hydraulic fluid source communicating with the hydraulic fluid supply passage;

a check valve in the hydraulic fluid supply passage between the hydraulic fluid source and the piston bore;

a first spring disposed between the motion absorbing piston and the hydraulic piston; and a second spring biasing the hydraulic piston into the piston bore, wherein the hydraulic piston and the motion absorbing piston are configured such that a volume of hydraulic fluid in the piston bore and checked by the check valve causes the motion absorbing piston to engage the hydraulic piston within the internal cavity, thereby permitting conveyance of auxiliary valve actuation motions to the engine valve train element.

2. The system of claim 1, wherein a rocker arm forms said housing.

3. The system of claim 1, wherein the housing is provided in a fixed position relative to the engine valve.

4. The system of claim 1, further comprising a cam operatively connected to the hydraulic piston, said cam having a main event follow lobe and an auxiliary event lobe.

5. The system of claim 4, wherein the cam is operatively connected to the hydraulic piston by a master piston and a master piston hydraulic passage extending between the master piston and the piston bore.

6. The system of claim 4, wherein the cam is operatively connected to the hydraulic piston by the housing, and wherein a rocker arm forms the housing.

7. The system of claim 1, wherein the check valve is provided in a control valve.

8. The system of claim 1, further comprising an engine valve bridge having a sliding pin disposed in an end of the engine valve bridge, wherein the hydraulic piston or the motion absorbing piston contacts the sliding pin.

9. The system of claim 8, further comprising: means for actuating the engine valve bridge; and a hydraulic lash adjuster disposed between the means for actuating the engine valve bridge and the valve bridge.

10. The system of claim 1, further comprising: a reset bore provided in the housing; a reset passage extending through the housing from the piston bore to the reset bore; and a reset piston disposed in the reset bore.

11. The system of claim 10, further comprising a cam operatively connected to the housing, said cam having a main event lobe and an auxiliary event lobe.

12. The system of claim 1, wherein the first spring exerts a biasing force greater than a pressure force of the hydraulic fluid source, and the second spring exerts a biasing force less than a pressure force of the hydraulic fluid source.

13. A system for hydraulic lash adjustment and engine valve actuation comprising:

first and second engine valves;

a valve bridge extending between the first and second engine valves;

a sliding pin extending through an end of the valve bridge, wherein the sliding pin contacts the first engine valve;

means for actuating both the first and second engine valves through the valve bridge to provide a main valve event;

a housing disposed above the valve bridge, said housing having a piston bore and a hydraulic fluid supply passage communicating with the piston bore;

a hydraulic piston slidably disposed in the piston bore, said hydraulic piston having an internal cavity;

a motion absorbing piston slidably disposed in the hydraulic piston internal cavity;

a hydraulic fluid source communicating with the hydraulic fluid supply passage;

a control valve incorporating a check valve disposed in the hydraulic fluid supply passage between the hydraulic fluid source and the piston bore;

a first spring disposed between the motion absorbing piston and the hydraulic piston;

a second spring biasing the hydraulic piston into the piston bore; and a cam operatively connected to the hydraulic piston, said cam having an auxiliary event lobe, wherein the hydraulic piston or the motion absorbing piston contact the sliding pin, wherein the hydraulic piston and the motion absorbing piston are configured such that a volume of hydraulic fluid in the piston bore and checked by the check valve causes the motion absorbing piston to engage the hydraulic piston within the internal cavity, thereby permitting conveyance of auxiliary valve actuation motions to the engine valve train element.

14. The system of claim 13, wherein a rocker arm forms said housing.

15. The system of claim 13, wherein the housing is provided in a fixed position relative to the engine valve.

16. The system of claim 13, wherein the cam is operatively connected to the hydraulic piston by a master piston and a master piston hydraulic passage extending between the master piston and the piston bore.

17. The system of claim 13, wherein the cam is operatively connected to the hydraulic piston by the housing, and wherein a rocker arm forms the housing.

18. The system of claim 13, further comprising: means for actuating the engine valve bridge; and a hydraulic lash adjuster disposed between the means for actuating the engine valve bridge and the valve bridge.

19. The system of claim 13, wherein the first spring exerts a biasing force greater than a pressure force of the hydraulic fluid source, and the second spring exerts a biasing force less than a pressure force of the hydraulic fluid source.

20. The system of claim 13, further comprising a main event follow lobe provided on the cam.

21. A system for hydraulic lash adjustment and engine valve actuation comprising:

a rocker arm having a piston bore and a hydraulic fluid supply passage communicating with the piston bore;

a hydraulic piston slidably disposed in the piston bore, said hydraulic piston having an internal cavity;

a motion absorbing piston slidably disposed in the hydraulic piston internal cavity;

a hydraulic fluid source communicating with the hydraulic fluid supply passage;

a check valve in the hydraulic fluid supply passage between the hydraulic fluid source and the piston bore;

a first spring disposed between the motion absorbing piston and the hydraulic piston;

a second spring biasing the hydraulic piston into the piston bore;

a cam operatively contacting the rocker arm, said cam having a main event lobe and an auxiliary event lobe;

a reset bore provided in the housing;

a reset passage extending through the housing from the piston bore to the reset bore; and a reset piston disposed in the reset bore, wherein the hydraulic piston or the motion absorbing piston contact the engine valve, wherein the hydraulic piston and the motion absorbing piston are configured such that a volume of hydraulic fluid in the piston bore and checked by the check valve causes the motion absorbing piston to engage the hydraulic piston within the internal cavity, thereby permitting conveyance of auxiliary valve actuation motions to the engine valve train element.

22. The system of claim 21, wherein the first spring exerts a biasing force greater than a pressure force of the hydraulic fluid source, and the second spring exerts a biasing force less than a pressure force of the hydraulic fluid source.

* * * * *